United States Patent [19]

Sobie

[11] Patent Number: 5,010,607

[45] Date of Patent: Apr. 30, 1991

[54] DAMPING CHAMBER FOR WATERBED MATTRESS

[76] Inventor: Robert A. Sobie, #410-31 Reliance Court, New Westminister, B.C., Canada, V3H 6C6

[21] Appl. No.: 470,901

[22] Filed: Jan. 25, 1990

[30] Foreign Application Priority Data

Jan. 2, 1990 [CA] Canada ..... 2006972

[51] Int. Cl.[5] ..... A47C 27/08

[52] U.S. Cl. ..... 5/450; 5/451

[58] Field of Search ..... 5/451, 450, 452, 457, 5/449, 422

[56] References Cited

U.S. PATENT DOCUMENTS

| | | | |
|---|---|---|---|
| 4,325,152 | 4/1982 | Carpenter | 5/451 |
| 4,329,748 | 5/1982 | Finkelstein | 5/451 |
| 4,577,356 | 3/1986 | Johenning et al. | 5/451 |
| 4,864,670 | 9/1989 | Woll et al. | 5/451 |

*Primary Examiner*—Alexander Grosz

*Attorney, Agent, or Firm*—Seed and Berry

[57] ABSTRACT

The present invention provides a damping baffle for damping the wave action in a waterbed mattress. Each baffle is fixed to the mattress, and has an upper and lower chamber designed to provide firmness yet avoid undue stress on the weld between the mattress and baffle. The lower chamber is shorter in height and has a greater number of flow-permitting apertures than the upper chamber.

8 Claims, 3 Drawing Sheets

FIG. 3
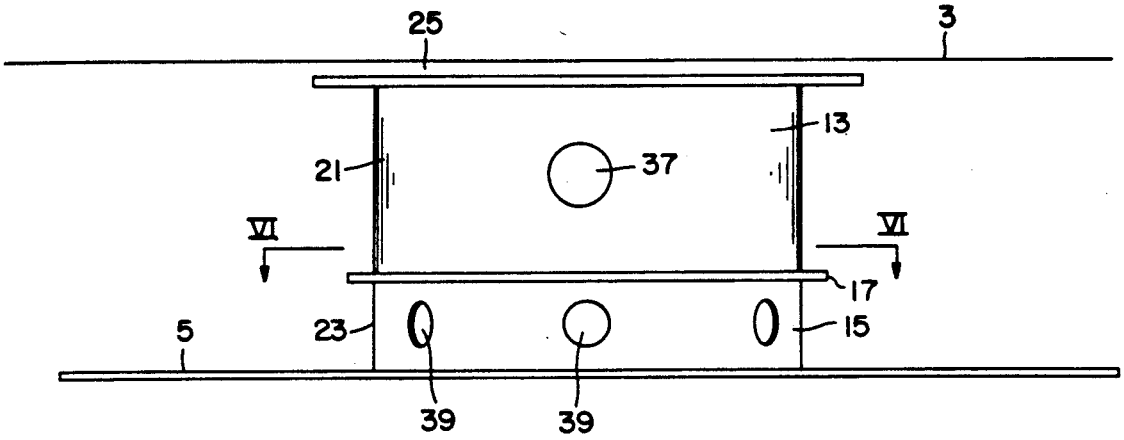
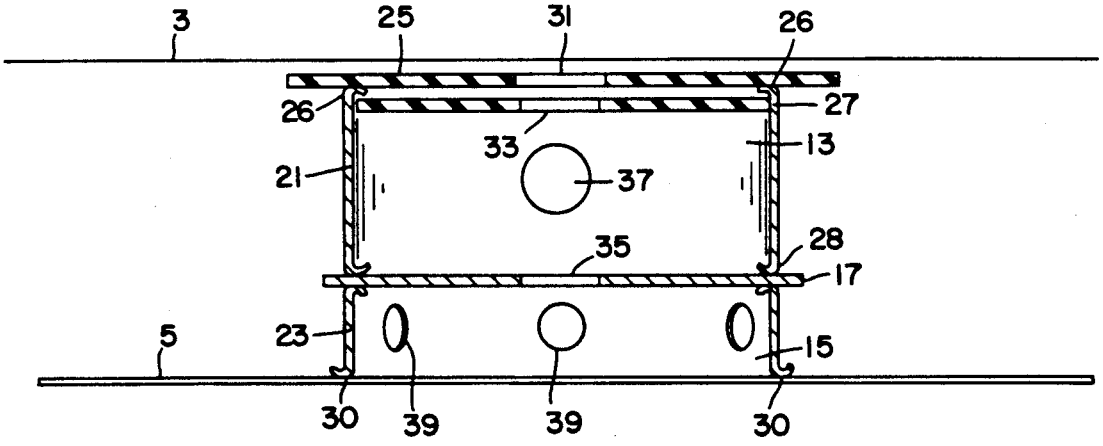
FIG. 4

DAMPING CHAMBER FOR WATERBED MATTRESS

BACKGROUND OF THE INVENTION

The invention relates to waterbed mattress construction and more particularly to the design of baffles used to dampen wave action in waterbeds.

One of the problems encountered in conventional waterbed design is the presence of wave motion within the waterbed mattress. A conventional waterbed comprises a water retaining bladder supported along its sides by a wooden frame. Where there is no provision for damping of wave motion within the mattress, movement of the person on the water-retaining bladder will generate waves within the bladder which reflect off the sides of the frame causing standing waves within the bladder at a resonant frequency depending on the volume of the bladder. This wave action is disturbing to the individual sleeping on the mattress.

Consequently, various means for damping the wave action have been attempted. For example, support frames having inclined side walls have been designed to reduce wave reflection, and fibrous materials have been introduced into the water to dampen wave motion. Various baffle constructions in the interior of the waterbed bladder have also been provided. Fogel Canadian Patent no. 1,100,238 provides elongated sheet baffles which are welded to the bottom inner surface of the bladder and are provided with flotation rods along the top edge of the baffle to extend it vertically in the interior of the bladder. Carson U.S. Pat. No. 3,736,604 discloses internal sheet baffles which are welded to the upper inner surface of the bladder and are weighted to hang downwardly. Labianco U.S. Pat. No. 3,840,921 discloses internal sheet baffles which are welded to the inner surface of the bladder along both top and bottom edges. None of these designs have been completely successful in damping wave action.

Another attempted solution to the damping of wave motion has been the provision of damping chambers in the interior of the bladder. Such a construction is shown in Carpenter U.S. Pat. No. 4,325,152. The damping chambers in this design are hollow right circular cylinders having flexible walls which are provided with a number of openings which allow the flow of water into and out of the interior of the chambers. The openings are symmetrically arranged circular holes with two sets of four holes being vertically spaced, the holes in each group of four being disposed at about 90 degrees from the horizontally adjacent hole. The holes comprise about 25 to 35 percent of the surface area of the cylinder. The lower end of the cylindrical chamber is fixed to the lower inner surface of the bladder, and the top end floats freely due to the provision of a disk of buoyant material held adjacent the upper inner surface of the cylinder. In this way the chambers extend vertically in the interior of the bladder to dampen wave action, and when the upper surface of the mattress is displaced downwardly, the interior surface of the bladder deforms the chamber and causes water to be expelled in different directions from the openings in the chamber, further impeding wave action.

A problem with such baffle structures which are welded to the waterbed mattress is that considerable stresses are placed on the joints and eventually either the baffle will break away from the bladder, thus reducing the wave damping function, or a leak will be created in the bladder itself. The firmer such mattresses are made (the greater the restriction on water flow out of the cylindrical chambers) the greater the stresses on the joints.

Phillips U.S. Pat. No. 4,475,257 discloses the use of an array of damping baffles or cells, each attached at its upper end to a top panel and each closed at its lower end except for a central aperture. The lower end is spaced above the bottom of the mattress in use. Each cell has its own flotation plate, and the top panel as a whole is free-floating. The top panel is provided with a circular array of holes in the vicinity of each cell which are closed by contact with the flotation plate when the top of the cell is forced downwardly. There is an array of secondary holes around the lower portion of the cell which are open when the cell is extended but close when it is compressed. In this way, apparently, bottoming out of the mattress is reduced while rapid recovery of the cells when pressure is removed is permitted. Smith U.S. Pat. No. 4,663,789 discloses a similar construction in which the lower end of the cells is attached to a free-floating panel while the upper ends are unconnected and provided with flotation panels. Such free-floating systems have not adequately solved the problem of wave action.

Fogel U.S. Pat. No. 4,715,076 discloses a two-part baffle, with inner and outer chambers, to provide wavelessness and firmness, but such baffles are difficult to manufacture.

There is therefore a need for a wave-damping baffle which reduces the problem of stress on the point of attachment of the baffle to the bladder while also preserving a firmness in the mattress.

SUMMARY OF THE INVENTION

The present invention provides a damping baffle for a waterbed mattress, which mattress comprises a top wall, bottom wall and side walls connecting said top and bottom walls and thereby forming a liquid-retaining envelope. The baffle comprises:

(a) a first chamber having a vertical side wall, the side wall having a lower edge and an upper edge, a top panel fixed to the upper edge of the side wall and a bottom panel fixed to the lower edge of the side wall, said side wall, top panel and bottom panel thereby separating the interior of the chamber from the exterior of the chamber;

(b) a second chamber connected to the bottom panel of the first chamber, the second chamber having a vertical side wall having a lower edge and an upper edge, the upper edge of the side wall being fixed to the bottom panel of the first chamber and the lower edge of the side wall being fixed to the bottom wall of the waterbed mattress; and (c) flotation means adjacent the top panel of the first chamber;

wherein the top panel and the side wall of the first chamber are each provided with at least one aperture to permit the flow of liquid between the interior of the first chamber and the exterior of the baffle, the bottom panel of the first chamber is provided with at least one aperture to permit the flow of liquid between the interior of the second chamber and the interior of the first chamber, and the side wall of the second chamber is provided with at least one aperture to permit the flow of liquid between the interior of the second chamber and the exterior of the baffle; and wherein the area of the aperture or apertures in the side wall of said second chamber is greater than the area of the apertures or apertures in the side wall of the first chamber;

and wherein the combined height of the side wall of the first chamber and the side wall of the second chamber is less than the height of the side wall of the waterbed mattress.

According to one aspect of the invention the chambers are cylindrical. The flotation means may also be provided with an aperture to permit liquid flow therethrough. Preferably the first chamber is greater in height than the second chamber.

The invention is further directed to a waterbed mattress which is provided with an array of such baffles fixed to the inner lower surface of the mattress.

BRIEF DESCRIPTION OF THE DRAWINGS

In drawings which illustrate a preferred embodiment of the invention:

FIG. 3 is a side elevational view of the damping baffles of the invention shown in FIG. 1;

FIG. 4 is a cross-sectional view taken along lines IV—IV of FIG. 5;

DETAILED DESCRIPTION OF A PREFERRED EMBODIMENT

With reference to the drawings, a waterbed mattress of standard construction is designated as 1. Such mattress is typically in the form of a flexible bladder 2, rectangular in shape, and constructed of flexible sheets of polyvinyl chloride, typically of 10 to 30 mils in thickness. It has flat top and bottom panels 3 and 5 respectively, flat side panels 7 and flat end panels 9. The top, bottom, side and end panels are welded together to form the watertight bladder in a conventional manner.

Figure 1:
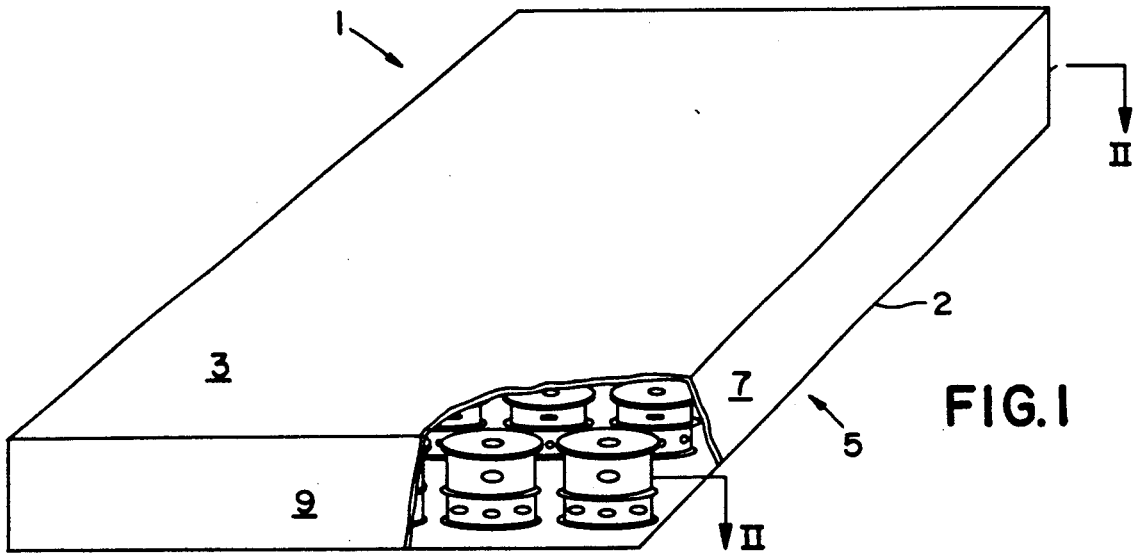
FIG. 1 is a perspective view of a waterbed mattress constructed using the damping baffles of the present invention, partially cut away to reveal the interior structure.
Figure 2:
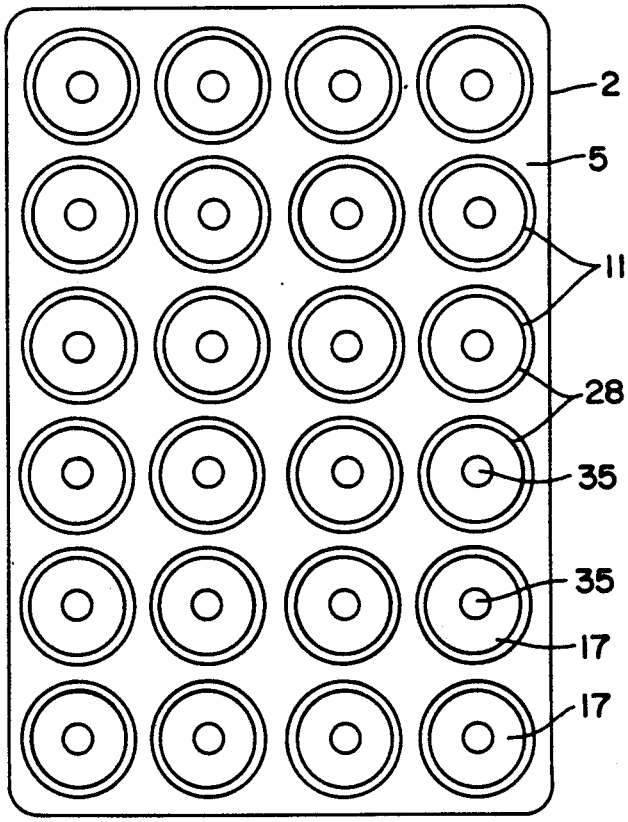
FIG. 2 is a cross-sectional view taken along lines II—II of FIG. 1.
Figure 5:
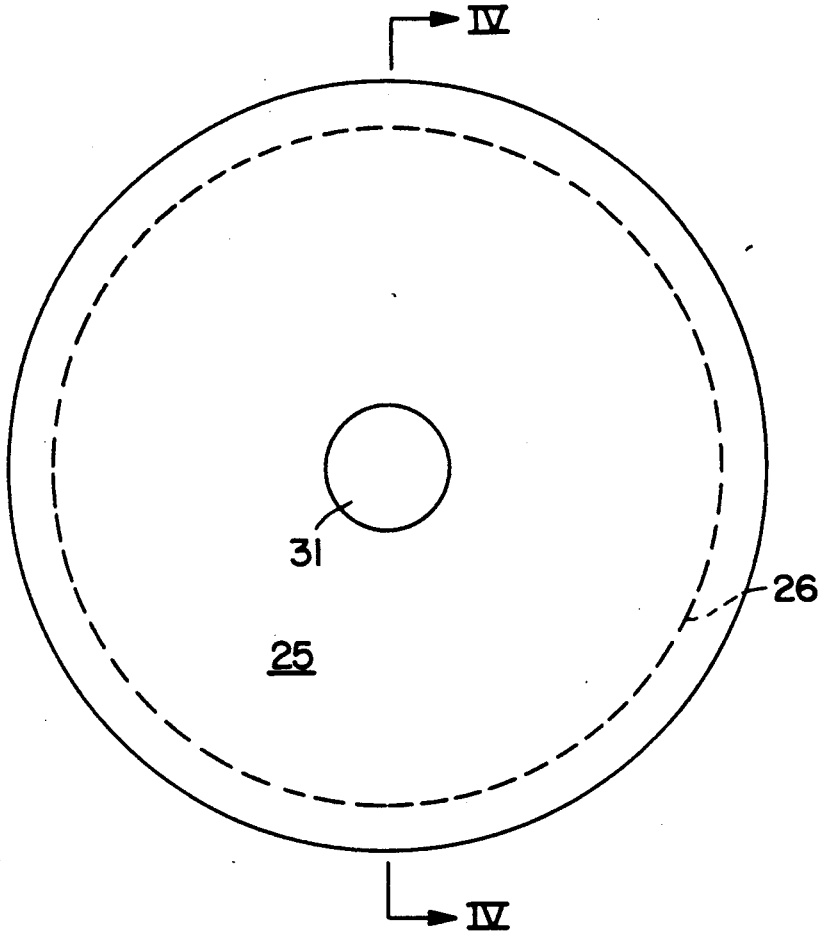
FIG. 5 is a top view of the damping baffles shown in FIG. 2.
Figure 6:
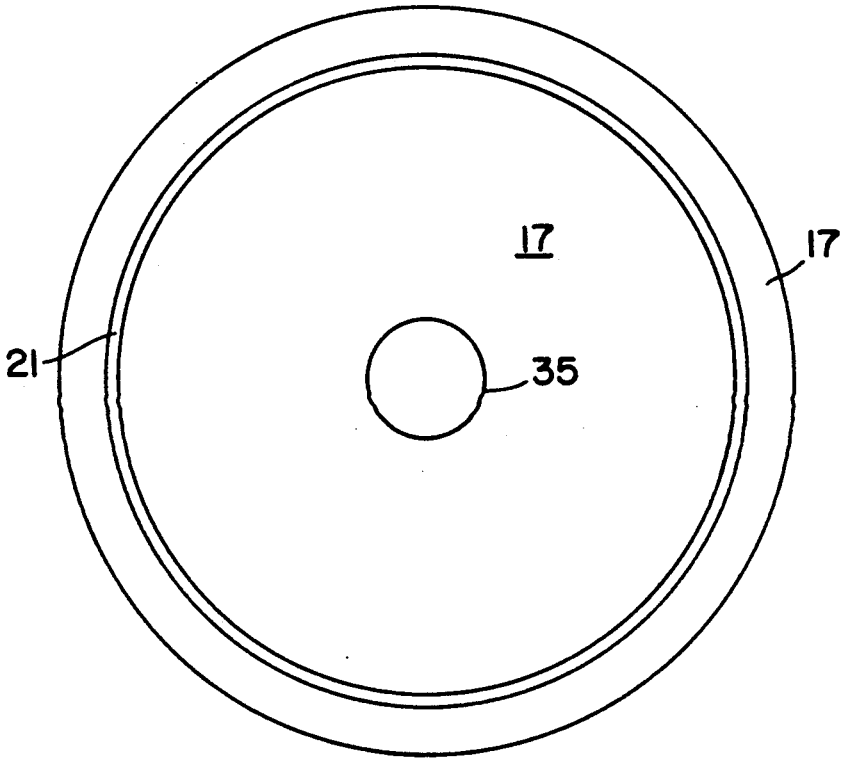
FIG. 6 is a cross-sectional view taken along lines VI—VI of FIG. 3.

The mattress 1 is provided with an array of cylindrical damping baffles 11 welded at regular intervals to the inner surface of the lower panel 5 as shown in FIG. 2. The structure of the damping baffles 11 is illustrated in FIGS. 3 through 6. Each damping baffle 11 is constructed of a flexible waterproof material similar to that from which bladder 2 is constructed, such as polyvinyl chloride. Each baffle consists of an upper chamber 13 and a lower chamber 15 formed by cylindrical walls 21 and 23 respectively, separated by panel 17. The upper edge of cylinder 21 is welded to top panel 25 along weld 26. (Where reference is made to welding, such joints may be butt welds or lap welds, according to standard methods. Lap welds are generally preferred for their greater strength.) The lower edge of cylinder 21 and the upper edge of cylinder 23 are both welded to panel 17 along weld 28. The lower edge of cylinder 23 is welded to lower panel 5 at weld 30. A circular disk 27 of a soft flotation material such as a closed cell polyurethane foam, is provided in the upper chamber 13. Disk 27 has a diameter slightly less than that of cylinder 21 and a thickness on the order of 3/16 inches, depending on the material. Preferably disk 27 floats freely in chamber 13, but it may also be fixed to the lower surface of panel 25.

Upper panel 25, disk 27 and panel 17 are all provided with centrally located holes 31, 33 and 35 respectively of approximately equal diameter. Upper cylinder 21 is provided with two diametrically opposed holes 37, and lower cylinder 23 is provided with six or more equidistantly spaced holes 39.

In the preferred embodiment, the diameter of chambers 13 and 15 is about 12 inches, the diameters of holes 31, 33, 35 and 37 is about 1.75 inches, and the diameter of holes 39 is about 1.25 inches. The height of cylinder 21 is approximately 6 inches and the height of cylinder 23 is approximately 2 inches.

In operation, the baffles 11 will be extended vertically when the bladder 1 is filled with water to a point near the upper panel 3 of the bladder due to the action of flotation disk 27. When a person sits or lies down on panel 3, hole 31 is blocked and panels 25 and 17 are displaced downwardly, causing water to be forced out through holes 35, 37 and 39. Due to the large number of holes in cylinder 23, initially there will be relatively low resistance presented by the baffle to downward movement of panel 3. The wall of cylinder 23, being shorter and more resilient, will be the first to collapse against the lower panel 5 of the bladder. At that point holes 35 are covered and further flow of water through them is prevented. Greater resistance is then presented to further downward movement of panel 3, since water can flow out of the baffle only through hole 37. Thus, the mattress will feel firm to the individual placing his or her weight on it. However once the baffle has reached the firm stage, that is after the top panel has depressed it by about two inches, there will no longer be large stresses on the joint since the wall of cylinder 23 is now in a loose and flexed state. Thus the present invention provides a firm support for most of the downward depression of the baffle, without high stress on the connection to the bladder.

When the weight is removed from panel 3, the flotation disk 27 raises panel 25 and water is allowed to flow back into the chambers 13 and 15 first through holes 31, 33 and 37 and subsequently through holes 39 and 35.

As will be apparent to those skilled in the art, various modifications and adaptations of the structure above described may be made without departing from the spirit of the invention, the scope of which is to be construed in accordance with the accompanying claims.

I claim:

1. A damping baffle for a waterbed mattress wherein said mattress comprises a top wall, bottom wall and side walls connecting said top and bottom walls and thereby forming a liquid-retaining envelope, said baffle having an interior and an exterior and comprising:

(a) a first chamber having a vertical side wall, said side wall having a lower edge and an upper edge, a top panel fixed to said upper edge of said side wall and a bottom panel fixed to said lower edge of said side wall, said side wall, top panel and bottom panel thereby separating the interior of said chamber from the exterior of said chamber;

(b) a second chamber connected to said bottom panel off said first chamber, said second chamber having a vertical side wall having a lower edge and an upper edge, said upper edge of said side wall being fixed to said bottom panel of said first chamber and said lower edge of said side wall being fixed to said bottom wall of said waterbed mattress; and (c) flotation means adjacent said top panel of said first chamber;

wherein said top panel and said side wall of said first chamber are each provided with at least one aperture to permit the flow of liquid between the interior of said first chamber and the exterior of said baffle, said bottom panel of said first chamber is provided with at least one aperture to permit the flow of liquid between the interior of said second chamber and the interior of said first chamber, and said side wall of second chamber is provided with at least one aperture to permit the flow of liquid between the interior of said second chamber and the exterior of said baffle; and wherein the area of said aperture or apertures in said side wall of said second chamber is greater than the area of said apertures or apertures in said side wall of said first chamber;

and wherein the combined height of said side wall of said first chamber and said side wall of said second chamber is less than the height of said side wall of said waterbed mattress, the height of said side wall of said first chamber being more than twice as great as the height of said side wall of said second chamber, and the volume of said first chamber being more than twice as great as the volume of said second chamber, and wherein said apertures are so configured that said second chamber collapses prior to said first chamber when said top wall of said waterbed mattress is forced downwardly against said top panel of said first chamber.

2. The baffle of claim 1 wherein said flotation is provided with at least one aperture to permit the flow of liquid therethrough.

3. The baffle of claim 1 wherein said side wall of said first and second chambers are cylindrical.

4. The baffle of claim 1 wherein said side wall of said first chamber is provided with two diametrically opposed apertures.

5. A waterbed mattress comprising:

(a) a flexible water-retaining bladder having a top wall, a bottom wall and side walls connecting the top and bottom walls;

(b) an array of damping baffles fixed to said bottom wall of said bladder, each said baffle comprising:

(i) a first chamber having a vertical side wall, said side wall having a lower edge and an upper edge, a top panel fixed to said upper edge of said side wall and a bottom panel fixed to said lower edge of said side wall, said side wall, top panel and bottom panel thereby separating the interior of said chamber from the exterior of said chamber;

(ii) a second chamber connected to said bottom panel of said first chamber, said second chamber having a vertical side wall having a lower edge and an upper edge, said upper edge of said side wall being fixed to said bottom panel of said first chamber and said lower edge of said side wall being fixed to said bottom wall of said bladder; and (iii) flotation means adjacent said top panel of said first chamber;

wherein said top panel and said side wall of said first chamber are each provided with at least one aperture to permit the flow of liquid between the interior of said first chamber and the exterior of said baffle, said bottom panel of said first chamber is provided with at least one aperture to permit the flow of liquid between the interior of said second chamber and the exterior of said first chamber, and said side wall of second chamber is provided with at least one aperture to permit the flow of liquid between the interior of said second chamber and said exterior of said baffle; and wherein the area of said aperture or apertures in said side wall of said second chamber is greater than the area of said aperture or apertures in said side wall of said first chamber;

and wherein the combined height of said side wall of said first chamber and said side wall of said second chamber is less than the height of said side walls of said bladder, the height of said side wall of said first chamber being more than twice as great as the height of said side wall of said second chamber, and the volume of said first chamber being more than twice as great as the volume of said second chamber, and wherein said apertures are so configured that said second chamber collapses prior to said first chamber when said top wall of said waterbed mattress is forced downwardly against said top panel of said first chamber.

6. The waterbed mattress of claim 5 wherein said flotation means is provided with at least one aperture to permit the flow of liquid therethrough.

7. The waterbed mattress of claim 5 wherein said side walls of said first and second chambers are cylindrical.

8. The waterbed mattress of claim 5 wherein said side wall of said first chamber is provided with two diametrically opposed apertures.

* * * * *

UNITED STATES PATENT AND TRADEMARK OFFICE

CERTIFICATE OF CORRECTION

PATENT NO. : 5,010,607

DATED : April 30, 1991

INVENTOR(S) : Robert A. Sobie

It is certified that error appears in the above-identified patent and that said Letters Patent is hereby corrected as shown below:

In column 5, claim 2, line 34, after "flotation" please insert --means--.

In column 5, claim 3, line 37, please delete "wall" and substitute therefor --walls--.

In column 6, claim 5, line 21, please delete "exterior" and substitute therefor --interior--.

Signed and Sealed this

First Day of September, 1992

*Attest:*

DOUGLAS B. COMER

*Attesting Officer*

*Acting Commissioner of Patents and Trademarks*